US007534151B1

(12) United States Patent
Billerbeck

(10) Patent No.: US 7,534,151 B1
(45) Date of Patent: May 19, 2009

(54) ELECTRICAL CONNECTION TERMINAL

(75) Inventor: Martina Billerbeck, Schieder-Schwalenberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 12/039,163

(22) Filed: Feb. 28, 2008

(51) Int. Cl.
*H01R 11/03* (2006.01)

(52) U.S. Cl. ..... 439/793; 439/798; 439/810

(58) Field of Classification Search ..... 439/793, 439/798, 810
See application file for complete search history.

(56) References Cited

U.S. PATENT DOCUMENTS 4,258,972 A * 3/1981 Strate ..... 439/793
5,727,314 A * 3/1998 Ashcraft ..... 439/810
5,848,913 A * 12/1998 Ashcraft ..... 439/798
6,764,354 B2 * 7/2004 Kaine et al. ..... 439/793
7,083,435 B2 8/2006 Lohr

* cited by examiner

*Primary Examiner*—Tho D Ta
(74) *Attorney, Agent, or Firm*—David S. Safran; Roberts Mlotkowski Safran & Cole, P.C.

(57) ABSTRACT

Electrical connection terminal has a connection terminal housing formed of an insulating material, at least one conductor connection element located in the connection terminal housing for connecting at least one external conductor, and at least one contact element which is electrically connected to the conductor connection element. The connection terminal housing has at least one conductor insertion opening for inserting a conductor to be connected and at least one actuation opening for actuating the at least one conductor connection element. The conductor insertion openings are surrounded by a peripheral wall which projects beyond a housing surface in which the conductor insertion openings are formed, and the actuation openings are surrounded by a peripheral wall which projects beyond a housing surface in which the actuation openings are formed. An electrical terminal having pin contacts can be assembled with another similar electrical terminal or a base body having U-shaped or tulip-type contacts.

16 Claims, 10 Drawing Sheets

ELECTRICAL CONNECTION TERMINAL

BACKGROUND OF THE INVENTION

1. Field of Invention

The invention relates to an electrical connection terminal with a connection terminal housing which is made of an insulating material, at least one conductor connection element located in it for connecting at least one external conductor, and at least one contact element which is electrically connected to the conductor connection element, in the connection terminal housing at least one conductor insertion opening for inserting a conductor to be connected and at least one actuation opening for actuating at least one conductor connection element being made. In addition, the invention relates to an electrical connecting clamp with two connection terminals and one terminal with a connection terminal and with a base body, the base body having a base housing and at least one metallic mating contact element located in it for making electrical contact with at least one contact element of the connection terminal.

2. Description of Related Art

Electrical connection terminals are used together with the corresponding connectors for connecting an electrical conductor to an electrical device, especially to the circuit board of an electrical device. Depending on the embodiment, the electrical connection terminals can be made as a socket part or as a connection terminal part. Since the corresponding electrical connector is connected mechanically and electrically to the circuit board, while the electrical conductors are connected to the connection terminal, the stationary electrical connector as a result of its attachment to the circuit board is also often called the base body.

Various embodiments of electrical connection terminals and the corresponding connectors, i.e., different base bodies, are known from practice. Here, the various connection terminals differ especially by the different connection possibilities for the conductors which are to be connected. Thus, connection terminals with screw, spring force, crimp and insulation displacement contacts are known. Conversely, the connectors and the base bodies differ especially in whether the mating contact element is made as a pin contact or a jack. The embodiment with the pin contact constitutes the standard version. If the base body has a pin contact as the mating contact element, the base body is made as a socket part into which the connection terminal which then has a jack is inserted.

The known connection terminals are generally made for connection of several conductors, so that they have a plurality of conductor connection elements and contact elements. After connecting the individual conductors to the conductor connection elements, the connection terminal can then be simply inserted into the corresponding socket connectors of the base body. These connection terminals are often also called connection terminal connectors and the corresponding base bodies are called base strips.

It was stated at the beginning that, in addition to the connection terminal and terminal, the invention also relates to a connecting clamp. Using an electrical connecting clamp, two or more conductors can be connected to one another. Accordingly, a connecting clamp, in contrast to a terminal, does not have a connection terminal and a base body; instead, a connecting clamp has two connection terminals, one connection terminal being made as a connection terminal part and the other connection terminal as a socket part. Both electrical terminals and also electrical connecting clamps are extensively used in electrical installations, i.e., in installation systems, especially in switchgear.

Since less and less installation space is available in switchgear and switchgear cubicles, electrical connection terminals and the corresponding base bodies with smaller and smaller dimensions have been under development for years. The minimum distance (spacing) of the conductor connection elements located in the connection terminal housing depends essentially on the maximum cross section of the conductors to be connected. However, the reduction in the dimensions of the connection terminal housing, especially of the spacing, which is desired for reasons of miniaturization, at the same time, leads to a limitation of the maximum allowable currents which may flow via the connected conductors and especially the maximum allowable rated voltage and the rated insulation voltage.

SUMMARY OF THE INVENTION

Therefore, a primary object of this invention is to provide an electrical connection terminal of the initially described type which is suited for power electronics, with a structural shape that is as small as possible by its having insulation resistance as high as possible.

This object is achieved in the initially described electrical connection terminal, first of all, in that the conductor insertion openings are surrounded by a peripheral wall which projects beyond the housing surface, and the actuation openings are likewise surrounded by a peripheral wall which projects beyond the housing surface. Providing peripheral walls, both in the region of the conductor insertion openings and also in the region of the actuation openings, easily but effectively increases the creep distances and clearances without the overall dimensions of the connection terminal being significantly increased.

Preferably, the conductor connection elements of the connection terminal are made as screw connection elements which each have a draw sleeve and a clamp screw. Thus, the individual conductors to be connected can be inserted via the connection terminal insertion openings into the individual draw sleeves, and the draw sleeves can be actuated via the screws which are each accessible to the tip of a screwdriver through the actuation openings.

For the connection terminals with screw connection elements the walls surrounding the conductor insertion openings are made essentially box-shaped and the walls surrounding the actuation openings are made annular. The walls surrounding the actuation openings are thus matched to the outside diameter of the screw heads and the walls surrounding the conductor insertion openings are matched to the contour of the draw sleeves. According to a preferred embodiment of the invention, the inside contour of the walls surrounding the conductor insertion openings is matched on at least two opposite sides to the outside diameter of the conductor to be connected or to the outside diameter of the wire end ferrules which surround the conductors to be connected. The inside contour of the conductor insertion openings thus has a slightly bulged shape, preferably the outside contour of the walls not being bulged, i.e., being essentially box-shaped.

Fundamentally, it is possible to make the connection terminal housing in one piece, then the conductor connection elements and the contact elements having to be jacketed such that they can still perform their function. If the conductor connection elements are screw connecting elements, this means that the draw sleeves must be arranged within the connection terminal housing such that they can be actuated by the screws. For the contact elements, this means that they must be located within the connection terminal housing such that they can be connected to the corresponding mating contact elements.

In order to facilitate the arrangement of the conductor connection elements and the contact elements in the connection terminal housing, it is preferably provided that the connection terminal housing is made in two parts, specifically a first housing part and a second housing part, the conductor connection elements and the contact elements being located and the actuation openings being made preferably in the first housing part, while only the conductor insertion openings are formed in the second housing part.

Even if it is fundamentally possible for the electrical connection terminal in accordance with the invention to have only one conductor connection element, and thus, also only one conductor insertion opening and one actuation opening as well as one contact element, the connection terminal is generally made for connecting several conductors so that it has a corresponding number of conductor connection elements and contact elements, and correspondingly, many conductor insertion openings and actuation opening are formed in the connection terminal housing. In this electrical connection terminal which is made for connection of several conductors, the connection terminal housing is preferably likewise made in two parts, so that it has a first housing part and a second housing part. In the first housing part there are preferably the conductor connection elements and the contact elements, and the actuation openings are formed, while in the second housing part the conductor insertion openings are made.

To increase the creep distances and clearances, the first housing part is preferably made such that there are at least two walls between two adjacent conductor connection elements. In other words, this means that the individual conductor connection elements on the two sides are assigned their own housing wall; adjacent conductor connection elements thus do not "share" a common housing wall.

If, according to the above described, preferred configuration of the electrical connection terminal in accordance with the invention there are two walls between two adjacent conductor connection elements, the walls are preferably made and arranged such that there is a clear space between the opposite walls. In this electrical connection terminal, then, it is also preferably provided that there is a respective partition in the second housing part which extends into the interior of the connection terminal housing between two adjacent conductor insertion openings so that, in the mounted state of the two housing parts, a respective partition of the second housing part extends into the clear space between the two walls of the first housing part. This inter-nested arrangement of the walls of the first housing part with the partitions of the second housing part greatly lengthens the creep distances and clearances between adjacent conductor connection elements, without this leading to a significant enlargement of the dimensions of the connection terminal.

According to a first embodiment, the electrical connection terminal in accordance with the invention has pin contacts as the contact elements so that the connection terminal housing is made as a socket part. While in the known connection terminals the pin contacts are arranged jointly in the receiving space of the connection terminal housing which is open on the face side, in the electrical connection terminal in accordance with the invention there is preferably a respective partition between adjacent pin contacts. In this way, the creep distances and clearances are increased so that the maximum allowable rated voltage and the rated insulation voltage are increased without the need to enlarge the dimensions of the electrical connection terminal.

According to a preferred configuration of an electrical connection terminal which has pin contacts, the free ends of the pin contacts are set back relative to the face side of the connection terminal housing, by which finger contact safety is easily enhanced. In addition, it can be provided that the free face side of the partitions and the parallel outside walls of the connection terminal housing are outwardly arched, i.e., are convex; to further increase the creep distances and clearances.

In an alternative embodiment, the electrical connection terminal in accordance with the invention has U-shaped contact springs or tulip-type contacts as contact elements so that the connection terminal housing is made as a connection terminal part which can be inserted into the corresponding socket part. The connection terminal housing is made such that there is at least one partition between two adjacent contact springs or tulip-type contacts. In this electrical connection terminal, the insulation resistance is preferably further increased by the individual contact springs or tulip-type contacts each being located in connection terminal housing regions which are separate from one another, there being a clear space between two adjacent housing regions. The individual contact springs or tulip-type contacts are then "encapsulated" in the individual housing regions.

In addition to an individual electrical connection terminal, this invention also relates to an electrical connecting clamp with which two or more conductors can be connected to one another. Such an electrical connecting clamp has two connection terminals in accordance with the invention, the first connection terminal having contact elements made as pin contacts and the other, second connection terminal having contact elements made as the corresponding U-shaped contact springs or tulip-type contacts.

Preferably, the contact springs or tulip-type contacts of the second connection terminal, as described above, are located in housing regions of the connection terminal housing which are separated from one another, so that there is a respective clear space between adjacent housing regions. If there is a respective partition between adjacent pin contacts of the first connection terminal, in the assembled state of the two connection terminals, these partitions can extend into the free spaces between the adjacent housing regions of the second connection terminal. This leads to contact pairs of the two connection terminals (pin contact and contact springs or tulip-type contacts) which are adjacent in the connection plugged-together state being insulated relative to one another both by the side walls of the individual housing regions and also by the partitions.

According to a preferred configuration of the electrical connecting clamp, the free face sides of the partitions of the first connection terminal and the face sides of the parallel outside walls of the connection terminal housing are outwardly arched, by which the creep distances and clearances are further increased, as described above. So that the dimensions of the electrical connecting clamp in the assembly state do not increase in these convexly made face sides of the partitions and the outside walls of the first connection terminal, it is preferably provided that grooves are formed in the wall of the second connection terminal which is opposite the face sides of the partitions and the outside walls in the assembled state of the two connection terminals into which the face sides of the partitions and of the outside walls which are arched to the outside extend.

In addition to a separate electrical connection terminal and a connecting clamp which is formed of two connection terminals, this invention also relates to an electrical terminal which has, in addition to a connection terminal in accordance with the invention, a base body with a base housing and at least one metallic mating contact element located in it for electrical contact-making of the contact element of the connection terminal. The base body is generally made such that it can be mounted on a circuit board. For this purpose, for example, one end of the mating contact elements can be made as a solder pin, which is inserted into a hole provided in the circuit board and then is soldered in it. In addition to this known technique of soldering-in, for some years there has also been so-called surface mount technology (SMT) in which one end of the mating contact elements is seated on the surface region of the circuit board which is covered with a solder paste. Then, the solder paste is melted by means of infrared radiation to produce the desired electrical connection between the end of the mating contact elements and the circuit board. With respect to the possible configuration of this base body, reference is made to German Patent DE 10 2004 009 071 B4 and corresponding U.S. Pat. No. 7,083,435.

In a preferred configuration of the electrical terminal in accordance with the invention, the contact elements of the connection terminal are made as pin contacts and the mating contact elements of the base body are made as U-shaped contact springs or tulip-type contacts. Then, preferably, there is a respective partition in the connection terminal housing between adjacent pin contacts and the contact springs or tulip-type contacts of the base body are located in housing regions of the base body which are separated from one another, between adjacent housing regions there being a respective clear space, so that the partitions of the connection terminal and base body extend into the clear spaces in the base housing in the assembled state of the connection terminal.

In particular, there are now numerous possibilities for embodying and developing the connection terminals and the electrical connecting clamp and the electrical terminal in accordance with the invention and in this respect reference is made to the following description of preferred embodiments in conjunction with the accompanying drawings.

DETAILED DESCRIPTION OF THE INVENTION

Figure 1:
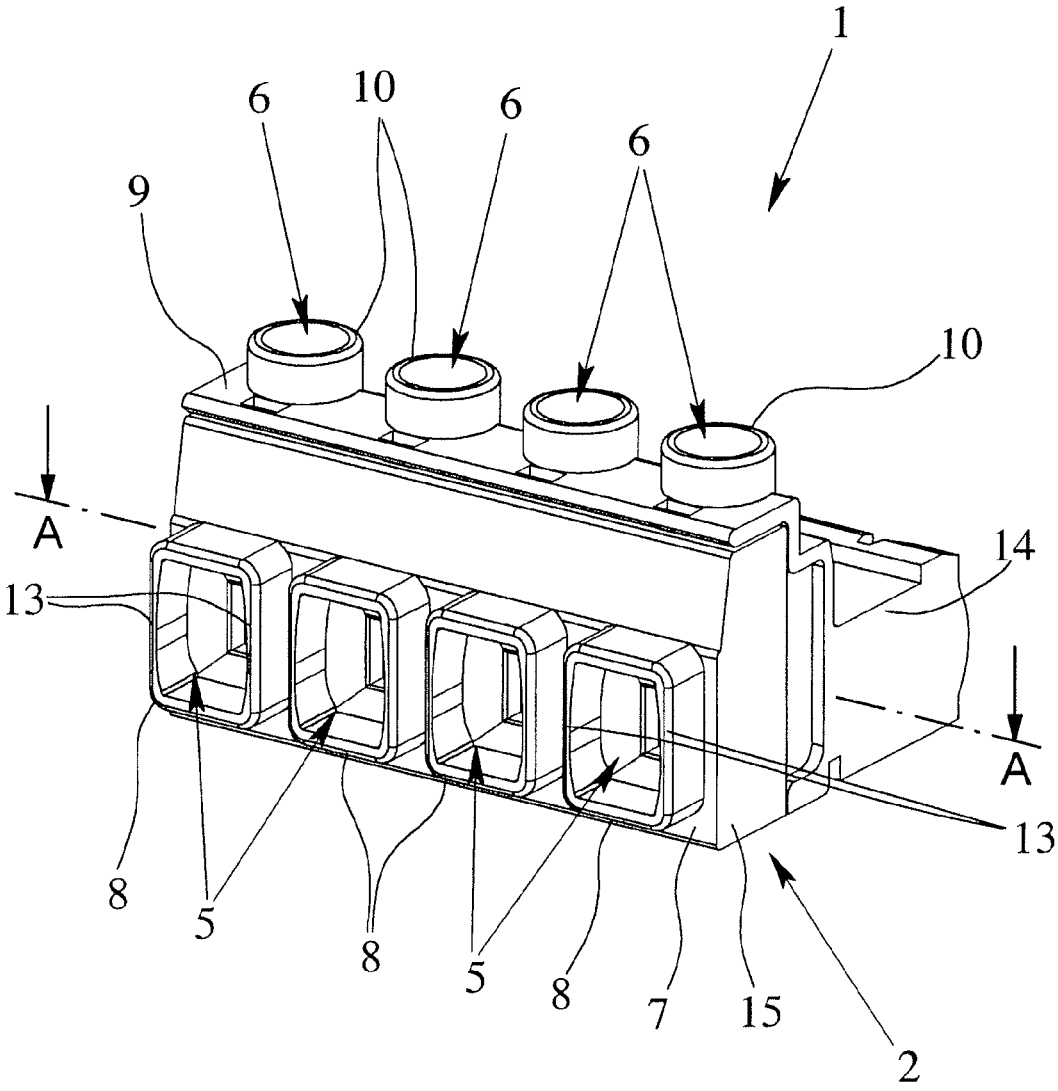
FIG. 1 is a perspective of a first embodiment of a connection terminal of the invention as seen from the conductor insertion side.

FIGS. 1 to 3 and 4 to 6 show two different embodiments of a connection terminal 1, 1' in accordance with the invention, the connection terminals 1, 1' each having a connection terminal housing 2 in which, for the two illustrated embodiments, there are four conductor connection elements 3 for connection of a maximum four conductors. In addition to the connection elements 3, in the connection terminal housing 2 there are four more contact elements 4, a respective conductor connection element 3 being connected in an electrically conductive manner to each contact element 4. Since a maximum four conductors can be connected to the electrical connection terminals 1, 1' shown in the Figs., in the connection terminal housing 2 four conductor insertion openings 5 for inserting the conductors to be connected and four actuation openings 6 are provided.

Figure 3:
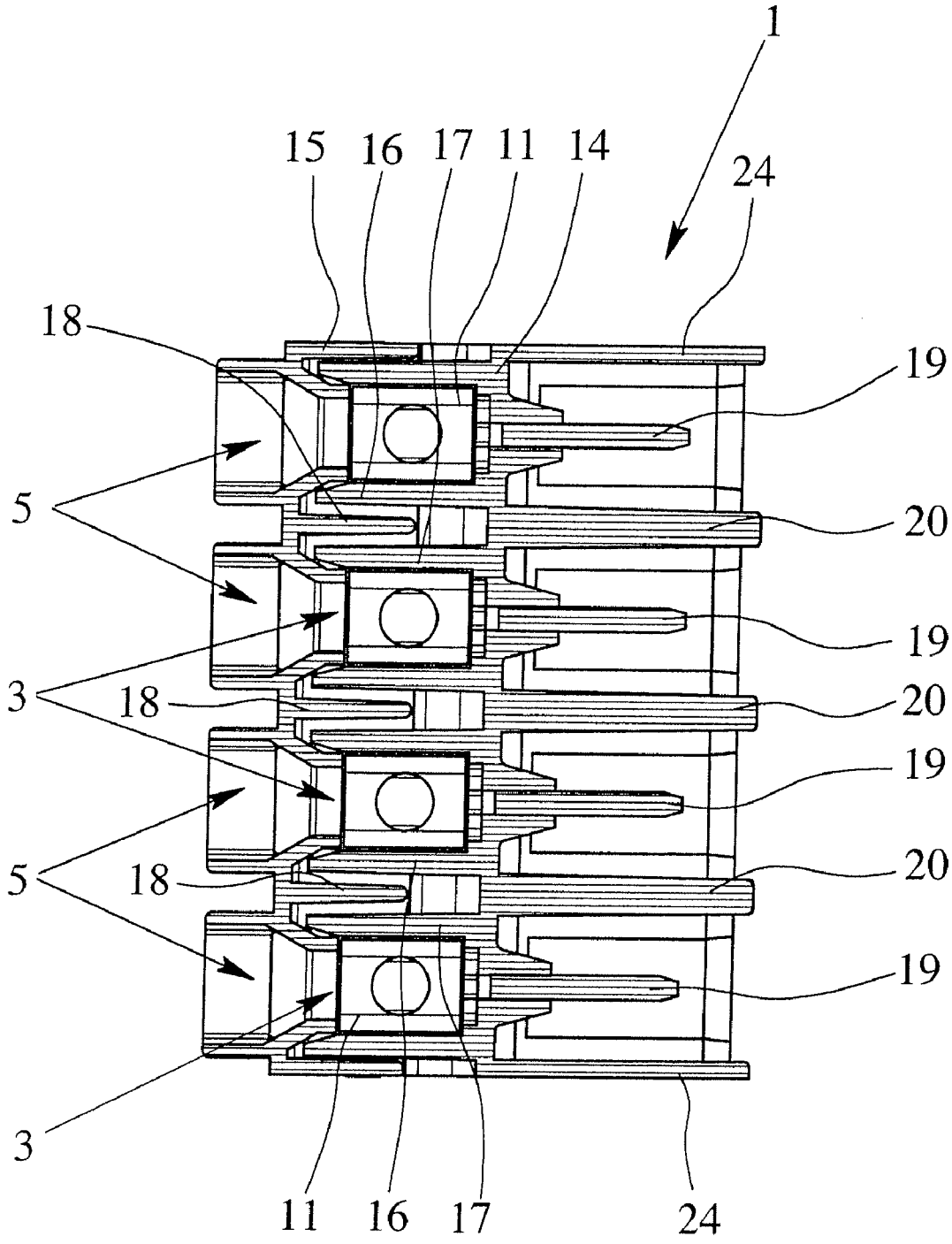
FIG. 3 is a sectional view taken along line A-A FIG. 1.
Figure 4:
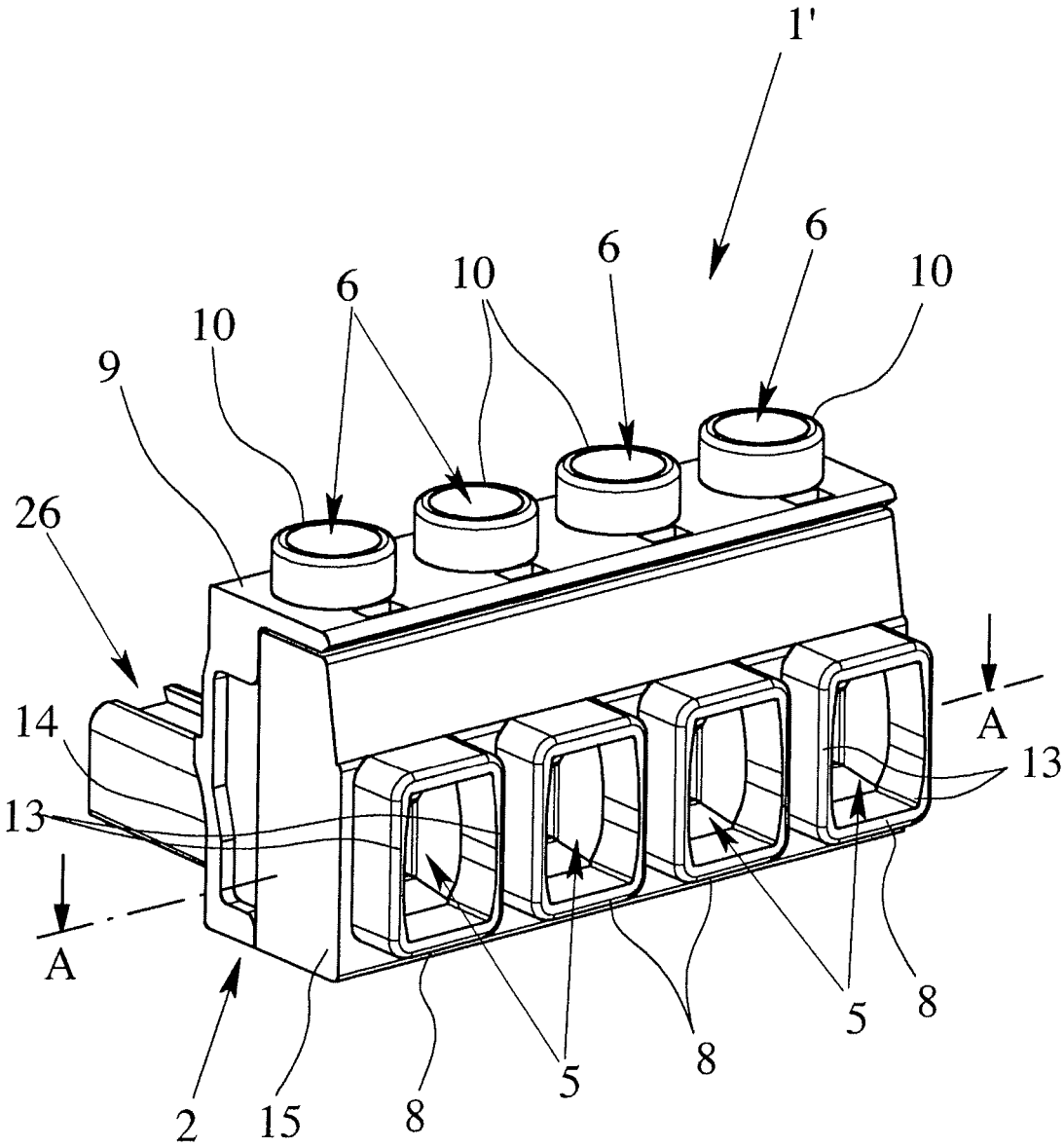
FIG. 4 is a perspective of a second embodiment of a connection terminal in accordance with the invention as seen from the conductor insertion side.
Figure 8:
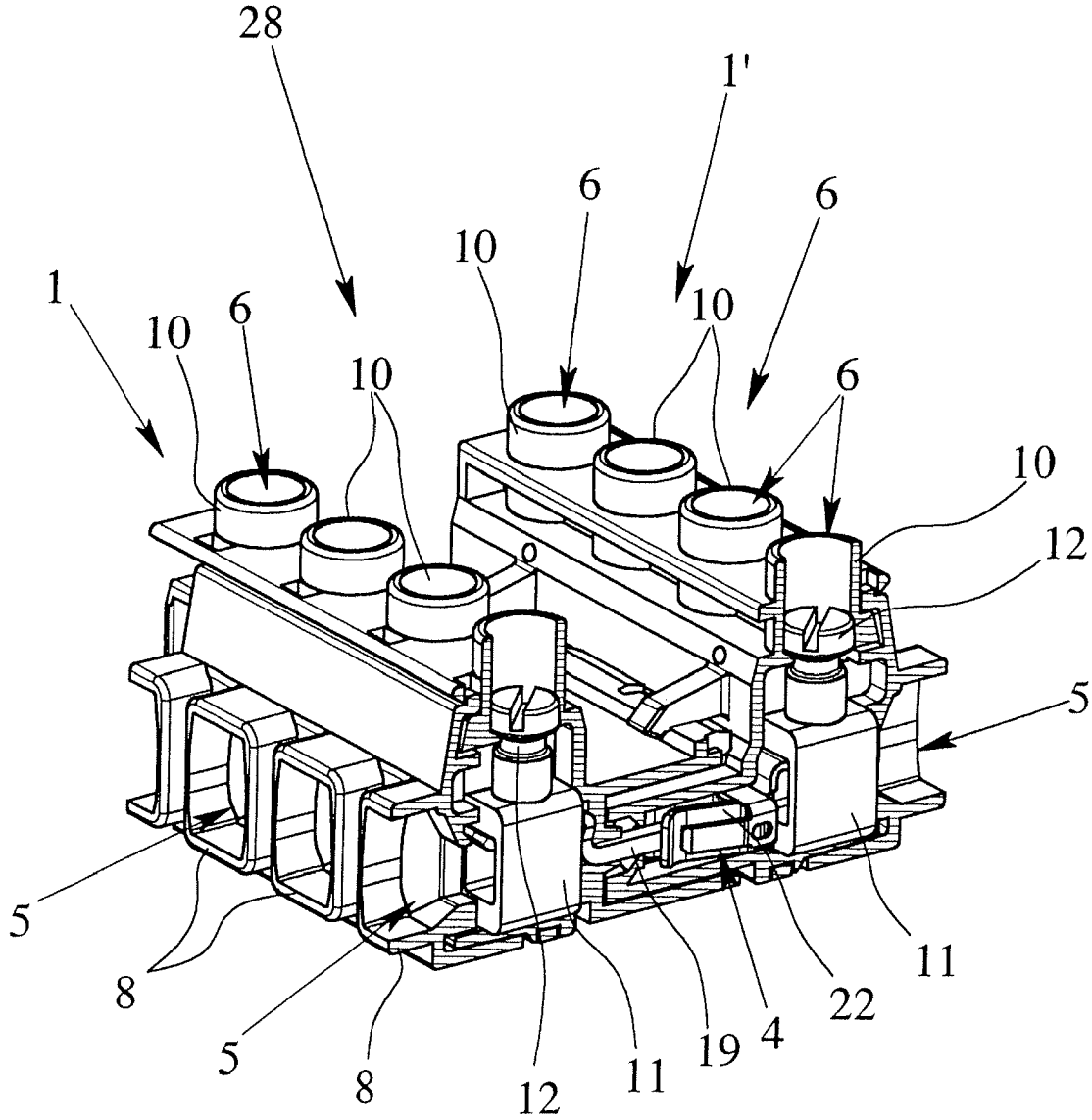
FIG. 8 is a partially cut away view of the connecting clamp of FIG. 7.

As is especially apparent from FIGS. 1 & 4, the conductor insertion openings 5 are each surrounded by a peripheral wall 8 which projects beyond the corresponding housing surface 7 and the actuation openings 6 are each surrounded by a peripheral wall 10 which projects beyond the second housing surface 9 which runs perpendicular to it. In the illustrated embodiments, the conductor connection elements 3 are made as screw connection elements so that the conductor connection elements 3 each have a draw sleeve 11 (FIGS. 3 & 6) and a screw 12 (as is shown in FIG. 8) and which can be turned by inserting the tip of a screwdriver into the actuation opening 6, by which the draw sleeve 11 is actuated to connect a conductor which has been inserted into the conductor insertion opening 5 in an electrically conductive manner to the corresponding contact element 4.

FIGS. 1 & 4 show that the walls 8 which surround the conductor insertion openings 5 are box-shaped and the walls 10 which surround the actuation openings 6 are annular. Moreover, it is apparent that the inside contour of the walls 8 which surround the conductor insertion openings 5 has a slightly bulged shape which is achieved by the two opposite lengthwise sides 13 of the wall 8 having a thickness which decreases toward the center. In this way, exact holding of conductors which have been provided with wire end ferrules is facilitated, since the inside contour of the walls 8 is matched to the outside dimensions of the wire end ferrules.

The connection terminal housing 2 in the illustrated preferred embodiments of the electrical connection terminals 1, 1' comprises a first housing part 14 and a second housing part 15. This two-part configuration of the connection terminal housing 2 facilitates the arrangement of the conductor connection elements 3 and the contact elements 4 within the connection terminal housing 2. As is apparent from FIGS. 3 & 6, the conductor connection elements 3 and the contact elements 4 are located in the first, larger housing part 14. Also, the actuation openings 6 are formed in the first housing part 14, while the conductor insertion openings 5 are made in the second, smaller housing part 15. The two housing parts 14, 15 are connected via correspondingly made catch projections and catch recesses.

To increase the creep distances and clearances, not only the walls 8, 10 on the housing surfaces 7, 9 which are perpendicular to one another, but also the special configuration of the interior of the connection terminal housing 2 are used. For this purpose, the first housing part 14 is made such that there are two walls 16, 17 between two adjacent conductor connection elements 3 on the side facing the second housing part 15. As is apparent from FIG. 3, the individual conductor connection elements 3, especially the individual draw sleeves 11 are enclosed on both sides by walls 16, 17. In addition, on the second housing part 15 partitions 18 are formed which are located between two adjacent conductor insertion openings 5 and extend into the interior of the connection terminal housing 2, so that the partitions 18 are located between adjacent pairs of walls 16, 17 of the first housing part 14 in the mounted state of the two housing parts 14, 15. The partitions 18 thus extend into the clear spaces which are formed between the adjacent pairs of walls 16, 17. As is apparent from FIGS. 3 & 6, this yields an inter-nested, labyrinth-like arrangement of the bridge-like walls 16, 17 and of the partition 18 of the two housing parts 14, 15, by which the creep distances and the clearances between adjacent conductor connection elements 3 are greatly enlarged without this leading to a significant increase of the outside dimensions of the connection terminal 1, 1'.

Figure 2:
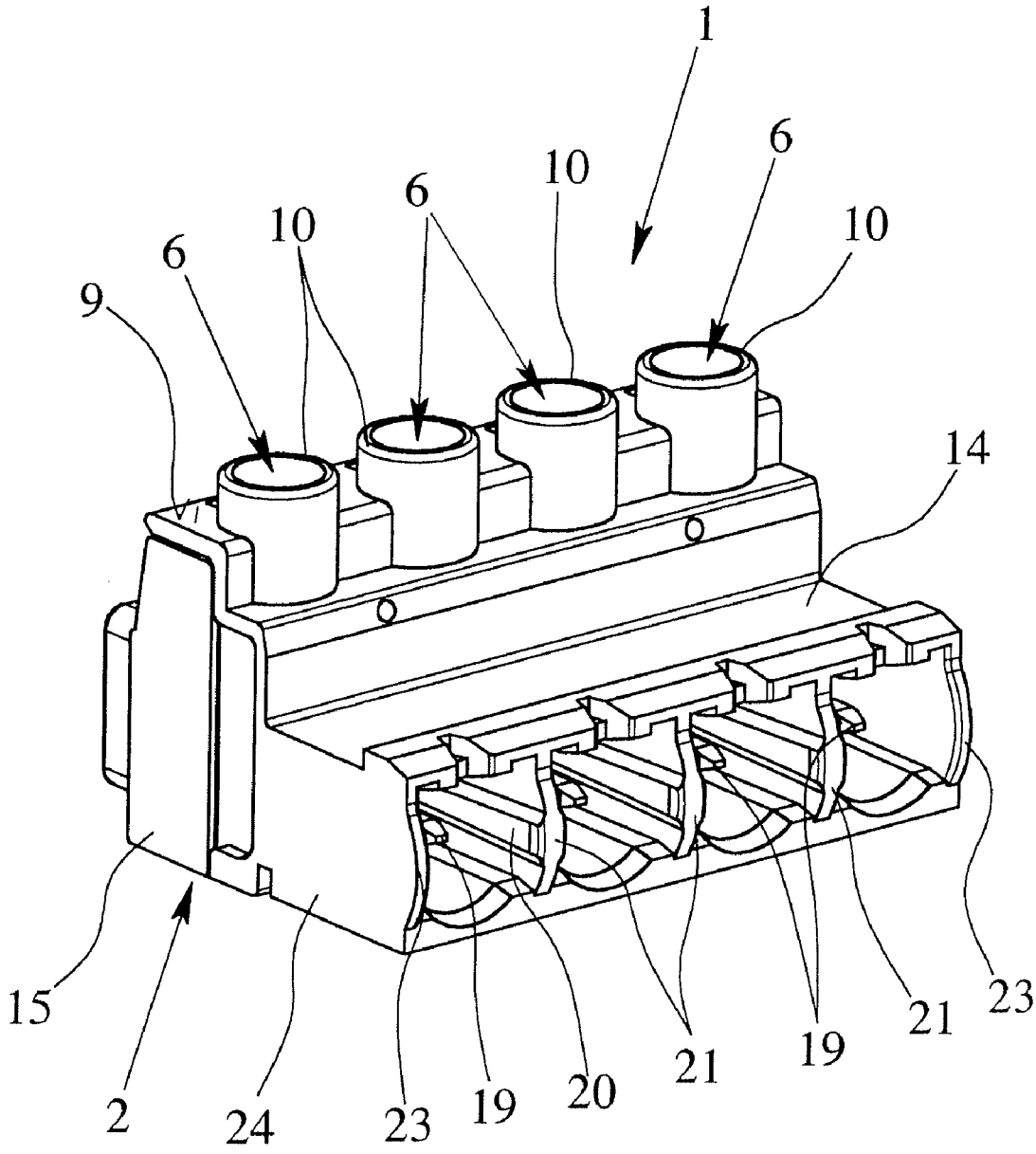
FIG. 2 is a perspective of the opposite side the terminal according to FIG. 1.
Figure 5:
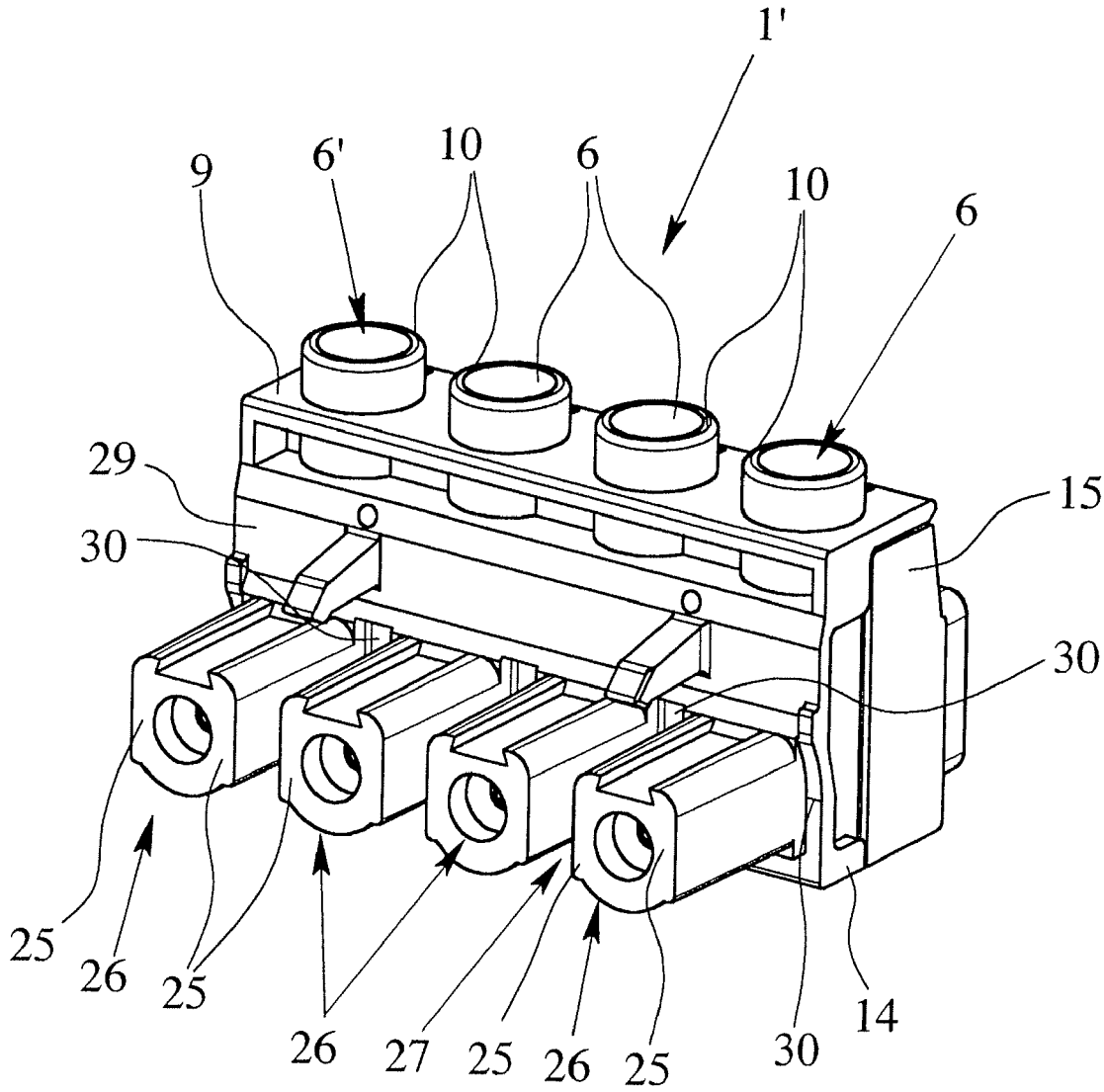
FIG. 5 shows a perspective of the terminal according to FIG. 4, from the opposite side.
Figure 6:
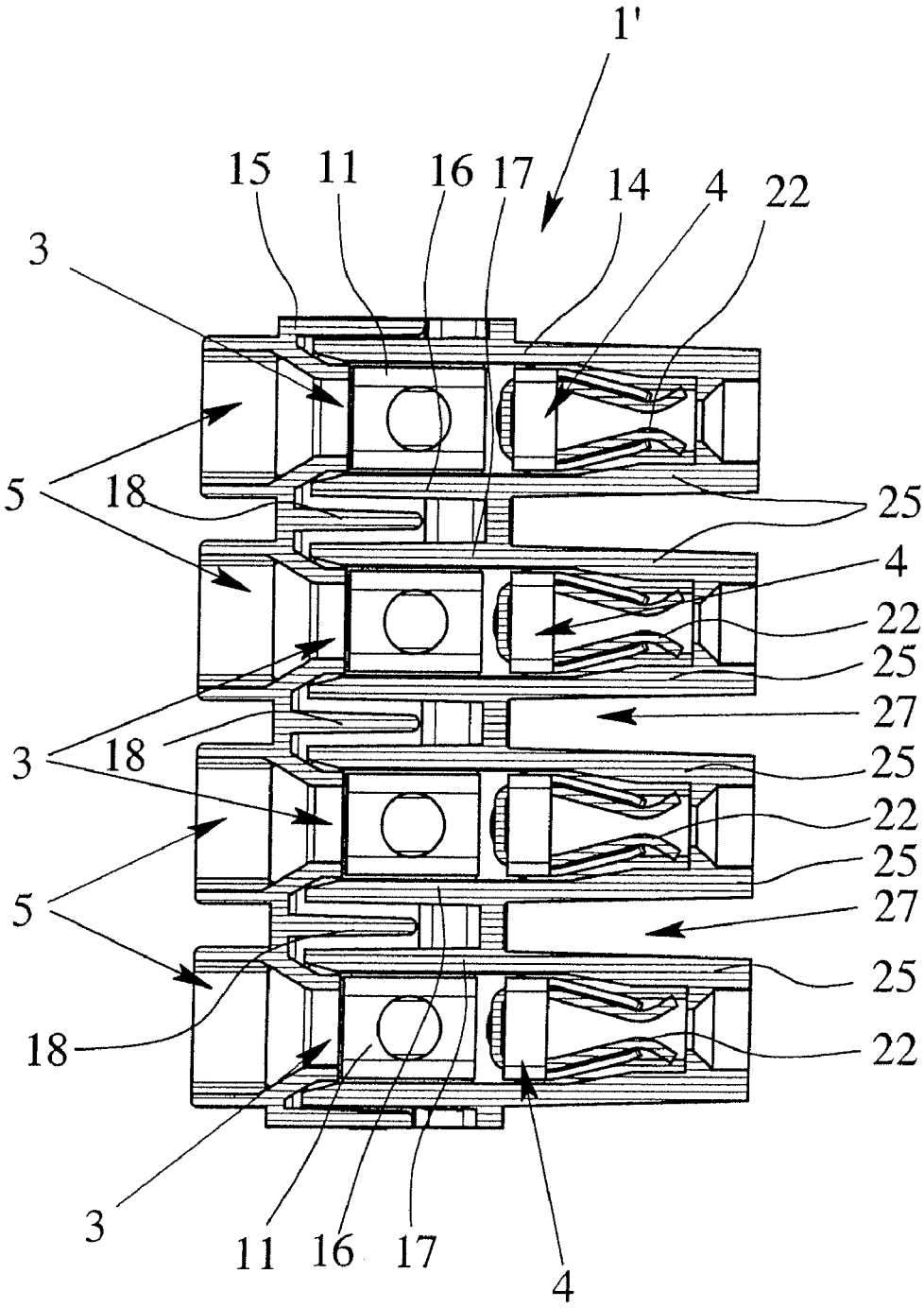
FIG. 6 shows the electrical terminal according to FIG. 4 in a section along line A-A.

The connection terminals 1, 1' which are shown, on the one hand, in FIGS. 1 to 3 and in FIGS. 4 to 6, on the other hand, differ from one another especially in that the contact elements 4 are made as pin contacts 19 for the connection terminal 1 shown in FIGS. 1 to 3, while the connection terminal 1' according to FIGS. 4 to 6 has tulip-type contacts 22 as contact elements 4. The individual pin contacts 19 of the connection terminal 1 according to the first embodiment are separated from one another in the connection terminal housing 2 by there being a respective partition 20 between adjacent pin contacts 19. As is apparent from FIG. 2, the free ends of the pin contacts 19 are set back relative to the face side of the connection terminal housing 2 so that increased finger contact safety, which is required at high allowable rated voltages of, for example, 600 volts, is ensured. In addition, the free edges 21 of the partitions 20 and the free edges 23 of the parallel running outer walls 24 of the connection terminal housing 2 are outwardly arched, i.e., are convex; this likewise leads to an increase of the creep distances and clearances.

As has already been stated, in the connection terminal 1' shown in FIGS. 4 to 6, the contact elements 4 are made as tulip-type contacts 22 (see, FIG. 6). Instead of the tulip-type contacts 22 shown here, there can also be other socket-shaped contact elements in the connection terminal housing 2, for example, U-shaped contact springs. FIG. 6 shows that the connection terminal housing 2 or the first housing part 14 is made such that there are two walls 25 between each adjacent pair of tulip-type contacts 22. Thus, in the same manner as the conductor connection elements 3, the tulip-type contacts 22 are enclosed on both sides by a wall 25. Specifically, the tulip-type contacts 22 are each located in housing regions 26 of the connection terminal housing 2 which are separated from one another by a clear space 27 that is located between each pair of adjacent housing regions 26.

Figure 7:
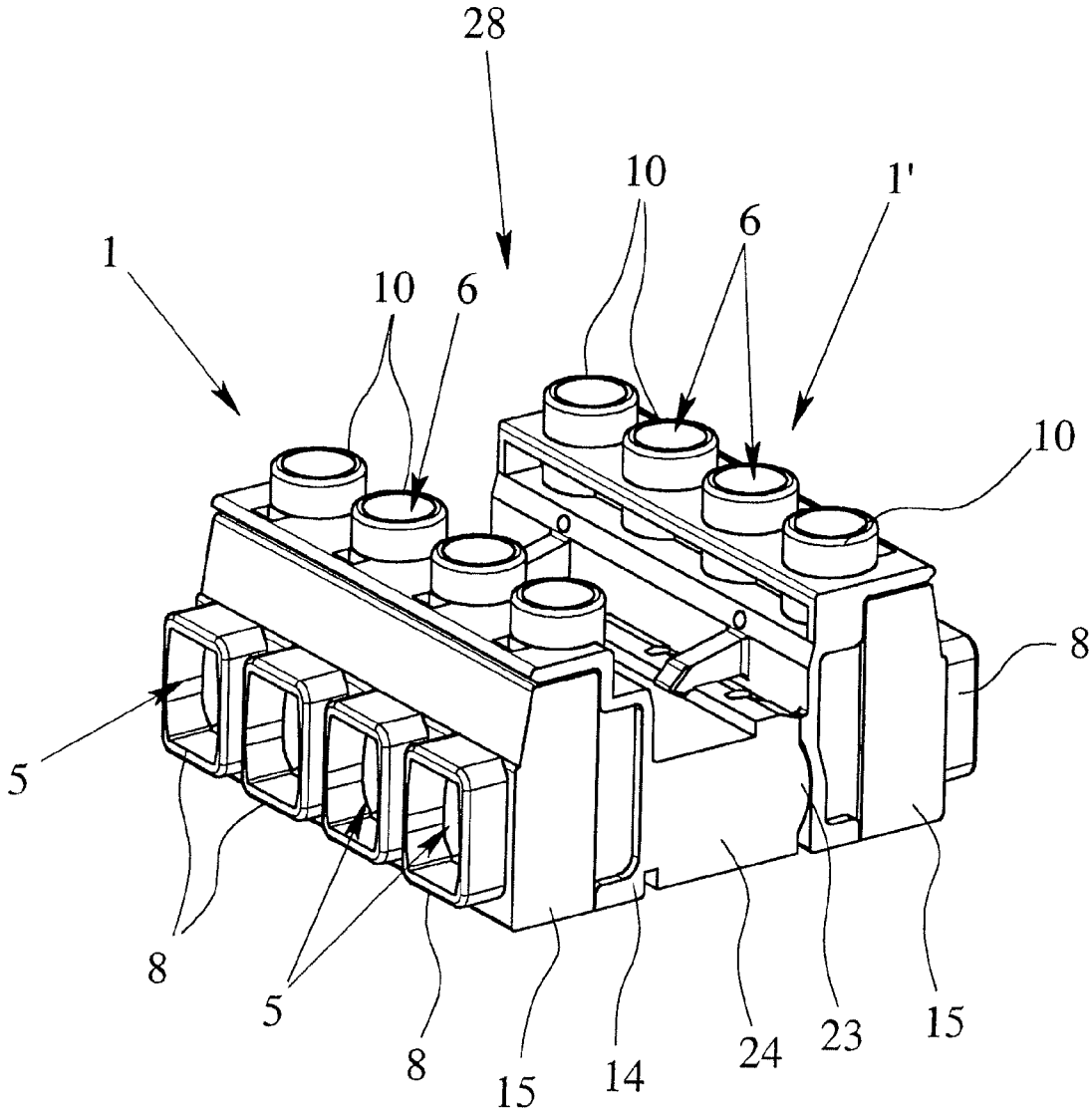
FIG. 7 is a perspective of an embodiment of a connecting clamp.

FIGS. 7 & 8 show an electrical connecting clamp 28 which are formed of a first connection terminal 1, as are shown in FIGS. 1 to 3, and of a second connection terminal 1' as shown in FIGS. 4 to 6. In this connection, FIG. 7 shows that the free edges 21 of the partitions 20 which are outwardly arched and the face side 23 of the outside walls 24 of the connection terminal housing 2 of the first connection terminal 1, which side is arched accordingly to the outside, in the assembled state of the two connection terminals 1, 1' extend into the corresponding grooves 30 which are made on the wall 29 of the connection terminal housing 2 of the second connection terminal 1', which wall is opposite the first connection terminal 1 (see also, FIG. 5).

FIG. 8 shows how the pin contacts 19 of the first connection terminal 1 are inserted into the tulip-type contacts 22 of the second connection terminal 1'. Furthermore, FIG. 8 shows the conductor connection elements made as screw connecting elements with the draw sleeves 11 and the screws 12 as well as the electrical connection between the conductor connection elements 3 and the contact elements 4.

Figure 9:
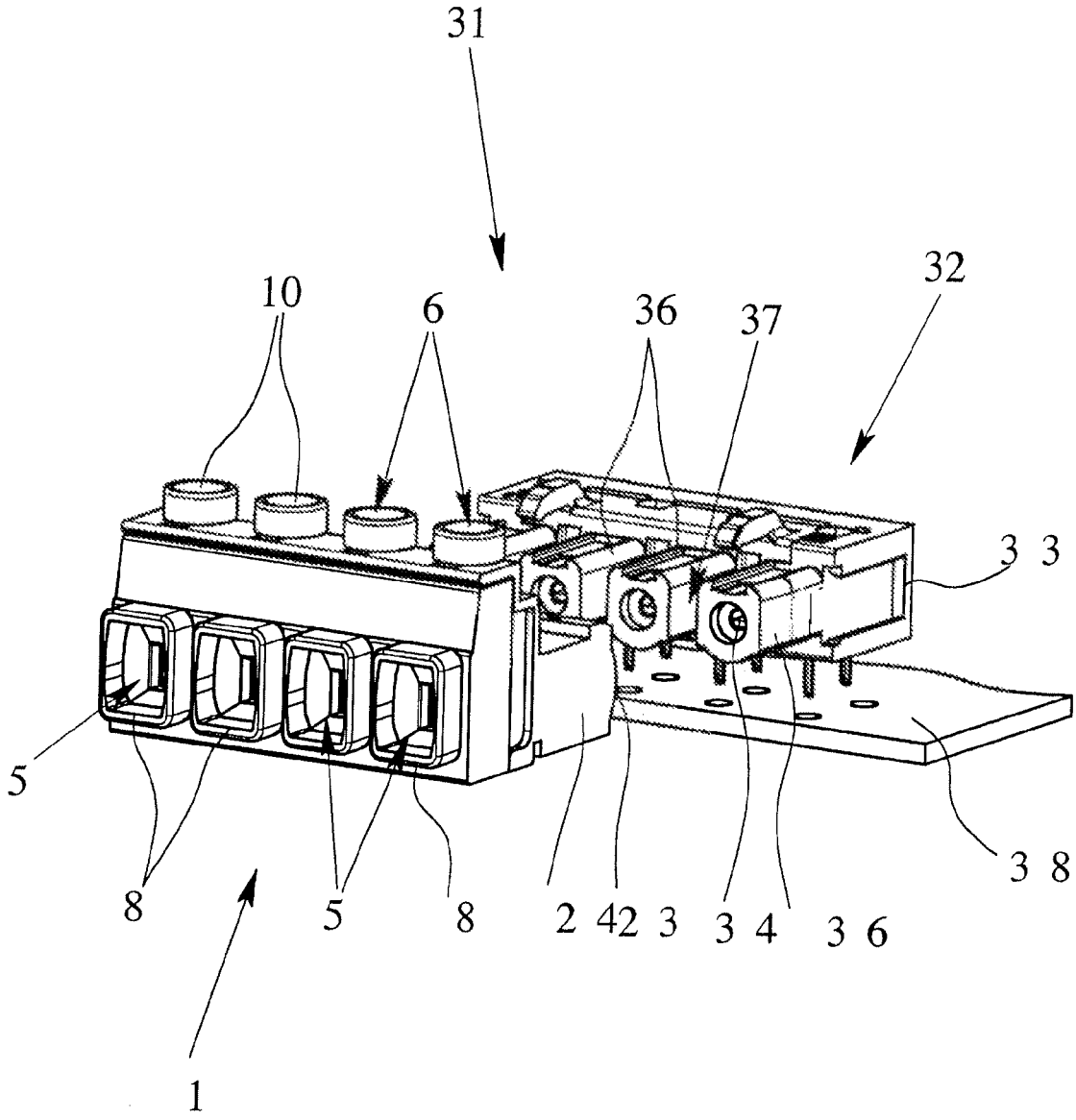
FIG. 9 shows a connection terminal just prior to being connected to a base body.
Figure 10:
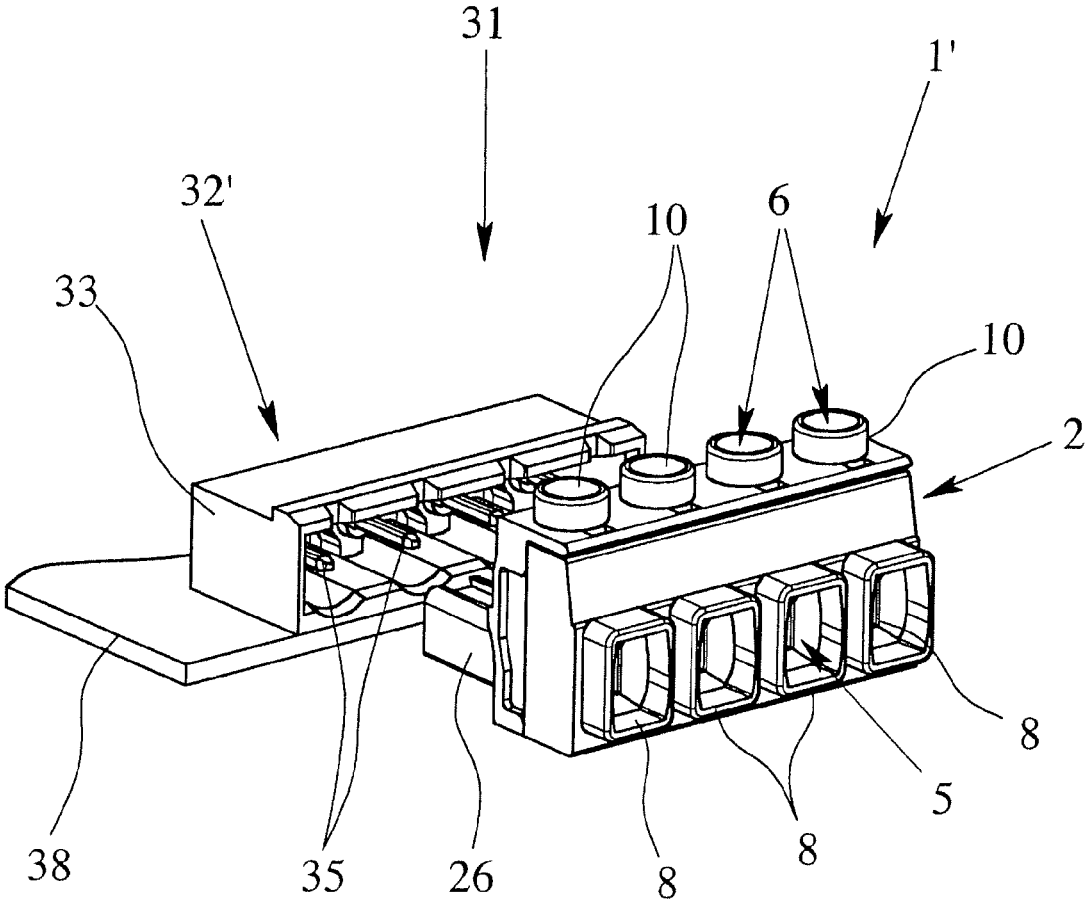
FIG. 10 shows a second embodiment of a connection terminal just prior to being connected to a base body.

Finally, FIGS. 9 & 10 show two embodiments of a terminal 31 which consists of a connection terminal 1', 1' and a base body 32, 32'. The base bodies 32, 32' shown in FIGS. 9 & 10 each have a base housing 33 and a number of mating contact elements which corresponds to the number of the contact elements 4.

While in the base body 32 according to FIG. 9, the mating contact elements are made as tulip-type contacts 34, the base body 32' shown in FIG. 10 has pin contacts 35 as mating contact elements. Corresponding thereto, the connection terminal 1 shown in FIG. 9 has pin contacts 19 and the connection terminal 1' shown in FIG. 10 has tulip-type contacts 22. The connection terminal 1 according to FIG. 9 thus corresponds to the connection terminal 1 shown in FIGS. 1 & 3, while the connection terminal 1' according to FIG. 10 corresponds to the connection terminal 1' shown in FIGS. 4 to 6.

In the terminal 31 shown in FIG. 9, the tulip-type contacts 34 of the base body 32, similarly to the connection terminal 1' shown in FIG. 5, are each located in housing regions 36 which are separated from one another so that, in the assembled state of the connection terminal 1 and the base body 32, the partitions 20 made in the connection terminal housing 2 between the individual pin contacts 19 extend into the clear spaces 37 between the housing regions 36 of the base housing 33. The electrical terminals 31 shown in FIGS. 9 & 10 are each used for connecting several conductors to a circuit board 38 on which the base body 32, 32' is attached such that the individual mating contact elements, i.e., the tulip-type contacts 34 or the pin contacts 35 are connected in an electrically conductive manner with their ends facing away from the connection terminal 1 to the individual printed conductors of the circuit board 38.

What is claimed is:

1. Electrical connection terminal, comprising:

a connection terminal housing formed of an insulating material, at least one conductor connection element located in the connection terminal housing for connecting at least one external conductor, and at least one contact element which is electrically connected to the conductor connection element, wherein the connection terminal housing has at least one conductor insertion opening for inserting a conductor to be connected and at least one actuation opening for actuating the at least one conductor connection element, wherein the conductor insertion openings are surrounded by a peripheral wall which projects beyond a housing surface in which the conductor insertion openings are formed, wherein the actuation openings are surrounded by a peripheral wall which projects beyond a housing surface in which the actuation openings are formed; and wherein the connection terminal housing is made of two parts, a first housing part and a second housing part which is separate from the first housing part the contact element and the actuation openings being located in the first housing part and the conductor insertion opening being located in the second housing part, and the first and second housing parts being connectable together after arrangement of the conductor connection elements and the contact elements within the connection terminal housing.

2. Electrical connection terminal in accordance with claim 1, wherein the conductor connection elements comprise screw connection elements, each of which is provided with a respective draw sleeve and screw.

3. Electrical connection terminal in accordance with claim 1, wherein the peripheral walls surrounding the conductor insertion openings are essentially box-shaped and the walls surrounding the actuation openings are annular.

4. Electrical connection terminal in accordance with claim 3, wherein an inside contour of the peripheral walls surrounding the conductor insertion openings is matched on at least two opposite sides to an outside diameter of conductors or wire end ferrules which surround the conductors to be connected.

5. Electrical connection terminal in accordance with claim 1, wherein said at least one conductor connection element comprises at least two conductor connection elements, wherein said at least one contact element comprises at least two contact elements, wherein said at least one conductor insertion opening comprises at least two conductor insertion openings, wherein said at least one actuation opening comprises at least two actuation openings.

6. Electrical connection terminal in accordance with claim 1, wherein the first housing part has at least two walls between adjacent conductor connection elements.

7. Electrical connection terminal in accordance with claim 6, wherein the second housing part has at least one partition between adjacent conductor insertion openings, and wherein said at least one partition extends between a respective said at least two walls of the first housing part when the first and second housing parts are connected together.

8. Electrical connection terminal in accordance with claim 1, wherein the contact elements are pin contacts, and wherein the connection terminal housing has a partition between adjacent pin contacts.

9. Electrical connection terminal in accordance with claim 8, wherein free ends of the pin contacts are set back relative to a face side of the connection terminal housing.

10. Electrical connection terminal in accordance with claim 8, wherein free edges of the partitions are outwardly arched.

11. Electrical connection terminal in accordance with claim 1, wherein the contact elements are one of U-shaped contact springs and tulip contacts, and wherein the connection terminal housing has at least one partition between adjacent contact elements.

12. Electrical connection terminal in accordance with claim 11, wherein the contact elements are each located in housing regions of the connection terminal housing which are separated from one another by a clear space.

13. Electrical connecting clamp, comprising:

a first connection terminal having:

a connection terminal housing formed of an insulating material, at least one conductor connection element located in the connection terminal housing for connecting at least one external conductor, and at least one contact element which is electrically connected to the conductor connection element, wherein the connection terminal housing has at least one conductor insertion opening for inserting a conductor to be connected and at least one actuation opening for actuating the at least one conductor connection element, wherein the conductor insertion openings are surrounded by a peripheral wall which projects beyond a housing surface in which the conductor insertion openings are formed, wherein the actuation openings are surrounded by a peripheral wall which projects beyond a housing surface in which the actuation openings are formed, and wherein the contact elements are pin contacts, and wherein the connection terminal housing has a partition between adjacent pin contacts; and a second connection terminal having:

a connection terminal housing formed of an insulating material, at least one conductor connection element located in the connection terminal housing for connecting at least one external conductor, and at least one contact element which is electrically connected to the conductor connection element, wherein the connection terminal housing has at least one conductor insertion opening for inserting a conductor to be connected and at least one actuation opening for actuating the at least one conductor connection element, wherein the conductor insertion openings are surrounded by a peripheral wall which projects beyond a housing surface in which the conductor insertion openings are formed, wherein the actuation openings are surrounded by a peripheral wall which projects beyond a housing surface in which the actuation openings are formed, and wherein the contact elements are one of U-shaped contact springs and tulip contacts, and wherein the connection terminal housing has at least one partition between adjacent contact elements;

wherein the contact springs or tulip-type contacts of the second connection terminal are located in housing regions of the connection terminal housing of the second connection terminal which are separated from one another by a clear space located between adjacent housing regions, and wherein the partitions between adjacent pin contacts of the first connection terminal extend into the clear spaces between adjacent housing regions of the second connection terminal when the first and second connection terminals are assembled together.

14. Electrical connecting clamp in accordance with claim 13, wherein a free edge of the partitions and a free edge of outside walls of the first connection terminal are outwardly arched, and wherein a wall of the second connection terminal which is opposite said free edges has grooves which match the arches of the free edges, said arches and grooves mating when the first and second connection terminals are assembled together.

15. Electrical connection terminal, comprising:

a connection terminal having:

a connection terminal housing formed of an insulating material, at least one conductor connection element located in the connection terminal housing for connecting at least one external conductor, at least one contact element which is electrically connected to the conductor connection element, and a base body having a base housing and at least one metallic mating contact element for making electrical contact with the at least one contact element of the connection terminal, wherein the connection terminal housing has at least one conductor insertion opening for inserting a conductor to be connected and at least one actuation opening for actuating the at least one conductor connection element, wherein the conductor insertion openings are surrounded by a peripheral wall which projects beyond a housing surface in which the conductor insertion openings are formed, wherein the actuation openings are surrounded by a peripheral wall which projects beyond a housing surface in which the actuation openings are formed, and wherein the connection terminal housing is made of two parts, a first housing part and a second housing part which is separate from the first housing part, the contact element and the actuation openings being located in the first housing part and the conductor insertion opening being located in the second housing part, and the first and second housing parts being connectable together after arrangement of the conductor connection elements and the contact elements within the connection terminal housing.

16. Electrical connection terminal in accordance with claim 15, wherein the contact elements are pin contacts, wherein the connection terminal housing has a partition between adjacent pin contacts; wherein mating contact elements of the base body are one of U-shaped contact springs or tulip contacts, wherein the contact springs or tulip-type contacts of the base body are located in housing regions which are separated from one another by a respective clearance space, and wherein the partitions between adjacent pin contacts of the connection terminal extend into the clear spaces in the base housing when the connection terminal and base body are assembled together.

* * * * *